US005254029A

United States Patent [19]

Myland

[11] Patent Number: 5,254,029

[45] Date of Patent: Oct. 19, 1993

[54] ARTICULATED ASSEMBLY FOR PUPPETS AND STUFFED TOY DOLLS

[75] Inventor: Mel Myland, Schinznach-Dorf, Switzerland

[73] Assignee: Glorex AG, Fullinsdorf, Switzerland

[21] Appl. No.: 844,666

[22] PCT Filed: Aug. 8, 1991

[86] PCT No.: PCT/CH91/00160

§ 371 Date: Apr. 6, 1992

§ 102(e) Date: Apr. 6, 1992

[87] PCT Pub. No.: WO92/02280

PCT Pub. Date: Feb. 20, 1992

[30] Foreign Application Priority Data

Aug. 10, 1990 [CH] Switzerland ..... 2615/90

[51] Int. Cl.[5] ..... A63J 19/00

[52] U.S. Cl. ..... 446/362; 446/359; 446/376

[58] Field of Search ..... 446/359, 361, 362, 363, 446/376, 379, 381, 383, 384

[56] References Cited

U.S. PATENT DOCUMENTS

| | | | |
|---|---|---|---|
| 1,901,707 | 3/1933 | Dunn et al. | 446/362 |
| 2,113,839 | 4/1938 | Hedges | 446/363 |
| 2,468,997 | 5/1949 | Osgood | 446/362 |
| 2,509,135 | 5/1950 | Coplan | 446/363 |
| 2,652,658 | 9/1953 | Barkey | 446/363 |
| 2,657,499 | 11/1953 | Rollins | 446/362 |
| 2,662,338 | 12/1953 | Baird | 446/363 |
| 2,747,329 | 5/1956 | Gruenewaelder | 446/363 |
| 3,707,803 | 1/1973 | Palmer | 446/363 |
| 3,898,764 | 8/1975 | Palmer | 446/363 |
| 3,914,897 | 10/1975 | Schoeman et al. | 446/363 |
| 4,690,655 | 9/1987 | Bailey | 446/362 |

FOREIGN PATENT DOCUMENTS

| | | | |
|---|---|---|---|
| 730377 | 3/1966 | Canada | 446/376 |
| 739163 | 7/1966 | Canada | 446/376 |
| 228275 | 11/1910 | Fed. Rep. of Germany . | |
| 550045 | 4/1932 | Fed. Rep. of Germany . | |
| 963231 | 7/1950 | France . | |
| 1048218 | 11/1966 | United Kingdom | 446/363 |

*Primary Examiner*—Robert A. Hafer
*Assistant Examiner*—Gregory Stone
*Attorney, Agent, or Firm*—Edwin D. Schindler

[57] ABSTRACT

The articulated assembly consists, on the one hand, of a cross-shaped neck-and shoulder element (1) made of roundwoods (6, 7) which encompasses the neck (2) and shoulder articulations (3, 4) and, on the other hand, of foot articulation elements (31, 32). Each of said articulations (2, 3, 4) at the neck-shoulder element (1) is formed by a closed eyelet (13, 15, 16) and a loop (12, 17, 18) passing through it, which loop is secured by its free end to the one side of the articulation. The hip articulation is formed by a piping hem (27) into which a roundwood (28) has been inserted. The foot articulations consist of a roundwood (31, 32) which exhibits a slot (33, 34) below, in which an eyebolt (35, 36), supported by a transverse nail, dangles, which eyebolt can be screwed into a wooden foot or a wooden shoe (37, 38).

6 Claims, 3 Drawing Sheets

ARTICULATED ASSEMBLY FOR PUPPETS AND STUFFED TOY DOLLS

BACKGROUND OF THE INVENTION

The present invention relates to an articulated assembly consisting of various structural elements for creating puppets or stuffed toy dolls. Puppets, on the one hand, are made in a straightforward design type, while stuffed dolls are provided with a cross-shaped control bar and control threads, in order to hang them primarily as decorative articles. These display puppets do not have any specially formed and technically complex body articulations. Their bodies are actually identical to those of ordinary dolls, for example, of stuffed dolls which are sewn together from a pattern and then stuffed. This kind of display doll lends itself on a very limited scale to being played with. Puppets used for professional puppetry, on the other hand, are usually individually produced articles, assembled with great attention to detail and in which every individual joint is technically of considerable complexity so that in their characteristics these joints approximate as much as possible the body's own natural articulations. Consequently, separately manufactured hinges are made for the neck joint, the shoulder joints, the elbow and even wrist joints as well as for the hip joint, knee, and foot joints.

In recent years stuffed dolls have witnessed a veritable rebirth of interest in them. Such dolls are distinguished by a body surface made of tricot fabric, while predominantly natural materials are used for the whole doll. Through the introduction of deep-drawn masks, today even hobbyists with little artistic talent can make very attractive dolls. Increasingly, there is a desire to design such dolls as puppets and, in particular, to make stuffed puppets capable of being manipulated, requiring but modest assembly effort on the part of the hobbyist.

SUMMARY OF THE INVENTION

The task of the present invention is to create an articulated assembly for the fabrication of such puppets and stuffed toy dolls which provides maximum manipulability while at the same time, keeps the amount of technical complexity required for its assembly to a minimum.

This task is solved on the basis of an articulated assembly for puppets and stuffed toy doll which is characterized by a neck-shoulder element for the neck and shoulder articulations, whereby each of said articulations is formed by a closed eyelet and a loop passing through it, which loop is fastened by its free end to one side of the articulation.

A practical embodiment of the articulated assembly is illustrated in the drawings and is described in detail in the description that follows, as is the function of the individual elements.

BRIEF DESCRIPTION OF THE DRAWING FIGURES

DETAILED DESCRIPTION OF THE DRAWING FIGURES

Figure 1:
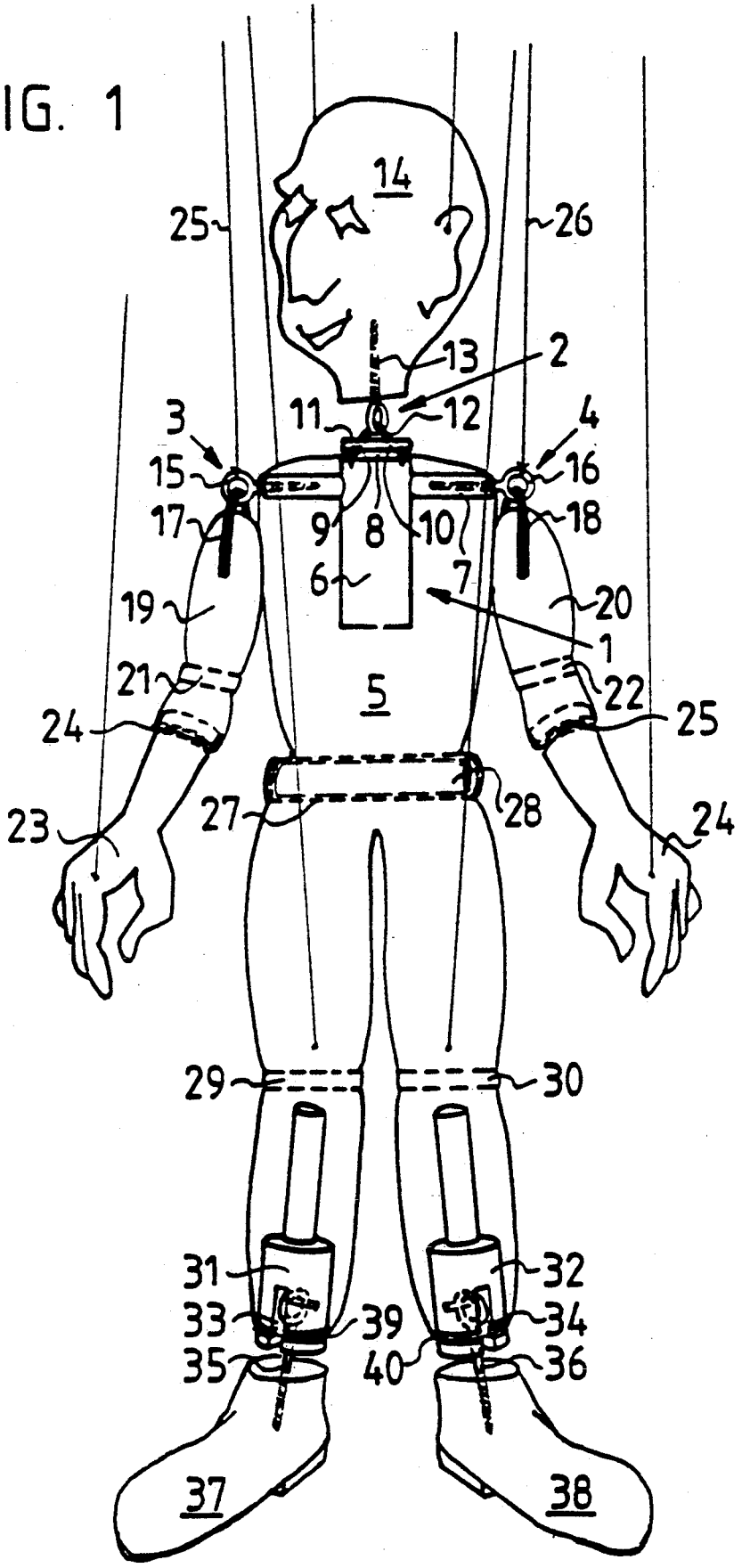
FIG. 1 shows a puppet made using the articulated assembly in accordance with the invention, with a wooden head, wooden hands and feet, in a frontal view.

FIG. 1 shows a first puppet made using the articulated assembly in accordance with the invention. The central element of the articulated assembly is the cross-shaped neck-shoulder element 1 with the articulation for the neck and head as well with both shoulder articulations 3, 4. This neck-shoulder element 1 consists of a round wood 6 which extends longitudinally along the trunk 5 of the puppet and a thinner round wood 7 which traverses said roundwood 6 in the shoulder area and which forms the puppets shoulder. Near the upper edge of the roundwood 6 the puppet exhibits a groove 8 around its circumference. In addition, two holes 9, 10 have been drilled from the upper front side 11 of the roundwood diagonally downwards and outwards, whereby the holes 9, 10 open out on the side below the groove 8. The holes 9, 10 in the front side exhibit a distance which corresponds approximately to one-third the diameter of the roundwood. A string 12 is drawn through these holes 9, 10 in such a way that a loop 12 is formed above the front side 11 of the roundwood 6. To form the loop, said string 12 is tied into a knot at both ends in front of the holes in the groove 8. By virtue of the placement of the knots the length of the loop 12 can be determined. At the top the loop 12 is also drawn through an eyebolt 13. If a wooden head 14 is used, then this eyebolt can be screwed simply from below into the neck extension of the wooden head 14, whereby the neck articulation has been completed. The plane in which the ring of the eyebolt must lie after tightening extends in the direction of view of the puppet's head 14. The loop 12 is adjusted beforehand in such a way that the head 14 can just be turned in a 180-degree angle, approximately, as would occur naturally. With a loop adjustment of this type the head 14 can also be inclined forwards and backwards, rather exactly as a natural head would do. By means of the articulated assembly in accordance with the invention, the entire freedom of movement of the head of a human being is imitated to a large extent. In particular, the head 14, like a natural head, can be rotated inside a cone-shaped shell and, at the same time, can be turned correspondingly right and left in any position. Nonetheless, the neck articulation 2 is of surprisingly simple design and, accordingly, can be inexpensively manufactured. During assembly of the puppet, the neck-shoulder element 1 described is sewn into the trunk 5. Ultimately, the groove 8 serves to draw in the fabric at the neck extension. When the puppet is completed the neck articulation 2 is hidden by a suitable collar.

The shoulder articulations 3, 4 are of a design similar to that of the neck articulation 2 in that, in this instance, an eyebolt 15, 16, respectively, is screwed into the external front side of the roundwood 7 which forms the shoulders. Strings 17, 18, in turn, are drawn through these eyebolts 15, 16 and their free ends are sewn into the arms 19, 20 which are stuffed in the conventional manner, with the result that a loop 17, 18, respectively, passes through the eyebolts 15, 16. Said shoulder articulations 3, 4 thus imitate ball-and-socket joints. Accordingly, the arms can be rotated, raised or crossed in front to a limited degree. The extent of their rotational freedom is determined by the width of the loops 17, 18. Said loops are advantageously sewn securely to the arms in such a way that the arms can execute a complete turn. The eyebolts 15, 16 of the shoulder articulations 3, 4 function at the same time to secure the shoulder strings 25, 26 by simply tying them securely to the eyebolt 15, 16.

The elbow articulations are created by sewing on the covering tricot fabric there by means of a double seam. Special wooden hands 23 with forearm parts, which are part of the articulated assembly, are used for the hands. The forearms exhibit a round groove 24, 25 at the end of each forearm on the elbow-side. This round groove 24, 25 on each forearm functions to enable the hand 23 to be fastened to the stuffed part of the forearm. This is accomplished by drawing the fabric into the groove 24, 25, whereby a clean transition from the tricot fabric to the wood is created at the same time.

The hip articulation is created by means of a piping hem 27 into which a roundwood 28, the length of the hip width, has been sewn. By means of a hip articulation design of this type the ability of the upper part of the body to twist vis-a-vis the legs is restricted, as occurs with the natural body. Moreover, an articulation is defined which functions in particular to enable the puppet to bend or sit in a most natural appearing manner. The roundwood 28 in the piping hem 27 also affords secure attachment of the rump thread by enabling this thread to be tied axially around the roundwood 28 or an eyebolt to be screwed in axially from behind into the roundwood 28, on which eyebolt the rump thread can then be tied securely. In a manner identical to that used to create the elbow articulations, the knee articulations 29, 30 are created by means of two seams. For larger puppets it can be expedient to use a piping hem also, with roundwoods fitted inside, for both the knee articulations and the hip articulation. The feet or shoes are made of wood. To enable the latter to move as naturally as possible, the articulated assembly also comprises a special foot articulation. Said articulation consists of a lower leg portion 31, 32 which, respectively, consists of a roundwood which has a tapered diameter on top and whose thicker area, near the lower edge, exhibits a circumferential groove 39, 40. At the same time, the thicker area exhibits a slot 33, 34 which has been milled from below and which passes through the center of the roundwood. The ring of an eyebolt 35, 36 has been embedded in this slot 33, 34, whereby a nail has been driven in a radial direction through the slot 33, 34 and through the ring of the eyebolt 35, 36, such that the latter, with its screw tip, is able to dangle in the slot 33, 34 similar to the manner in which a clapper does in a bell. The screw 35, 36 is then tapped into a wooden foot or wooden shoe 37, 38. The fabric of the lower leg is then drawn over the wooden lower leg and into the groove 39, 40, whereby the foot articulation is completed. Depending on the distance, which can be adjusted between the wooden foot or wooden shoe and the wooden lower leg; the foot is more or less able to tilt up and down. When imitating walking, the foot automatically executes the natural rolling-off movement of the foot and, moreover, with such wooden feet striding or clattering sounds can even be consciously generated on the stage floor.

Figure 2:
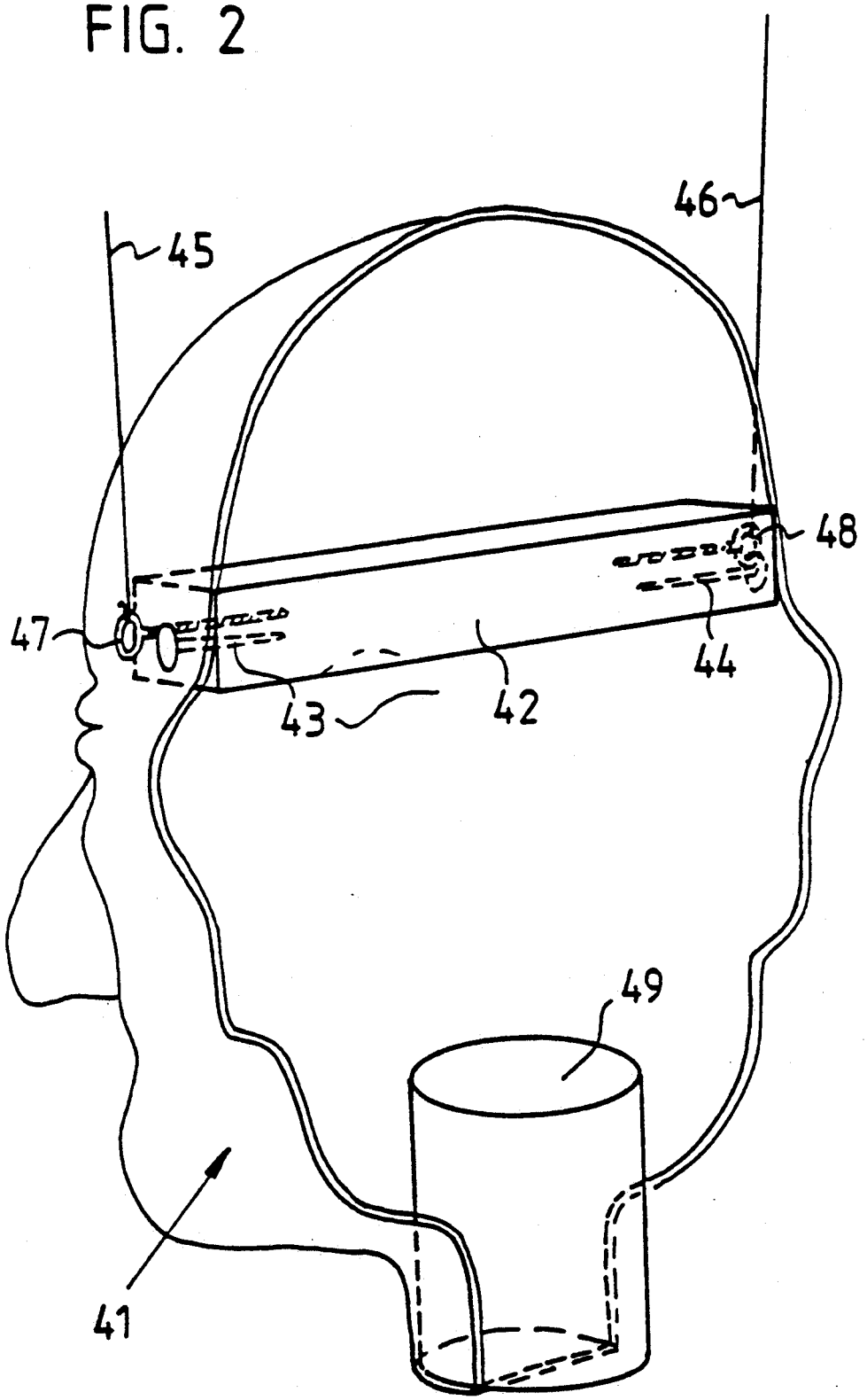
FIG. 2 shows a deep-drawn plastic mask diagonally from the back, with inserts enabling use of the mask as a puppet head.

FIG. 2 shows a special insert for deep-drawn makes if a head for a puppet is to be made using them. Usually, deep-drawn masks made of PVC are used to make stuffed dolls. The masks are brushed with glue and covered with the same tricot fabric from which the doll is otherwise made. The back of the head is then stuffed with cotton batting. However, because a puppet must also be hung by the head and the head must also be flexibly and, at the same time, frictionally connected with the trunk, this is not possible with a head made of a plastic mask that has been merely stuffed. The articulated assembly in accordance with the invention therefore also comprises an insert for plastic masks by means of which said masks can be used to put together puppet heads. FIG. 2 shows such a plastic mask 41, as seen diagonally from behind. The insert consists of a wooden traverse bar 42 whose length corresponds to the largest interior width of the mask 41. The traverse bar 42 is securely nailed from the outside in the mask by means of nails 43, 44. The nails 43, 44, consequently, are nailed into the front sides of the traverse bar 42. To fasten the head threads 45, 46, small eyebolts 47, 48 can be additionally screwed from the outside into the front sides of the traverse bar 42, to whose rings the head threads 45, 46 can then be securely tied. For smaller, lighter puppets nails may suffice instead of eyelets. To ensure that the head created by means of the mask 41 can be securely yet flexibly and frictionally connected to the trunk, a wood cylinder 49 has been glued into the neck portion of the mask. In these inserts are mounted in the mask, the back of the head can be stuffed as is traditional for a stuffed doll. The finished head can ultimately be screwed onto the eyelet on the neck-shoulder element, as has already been described.

Figure 3:
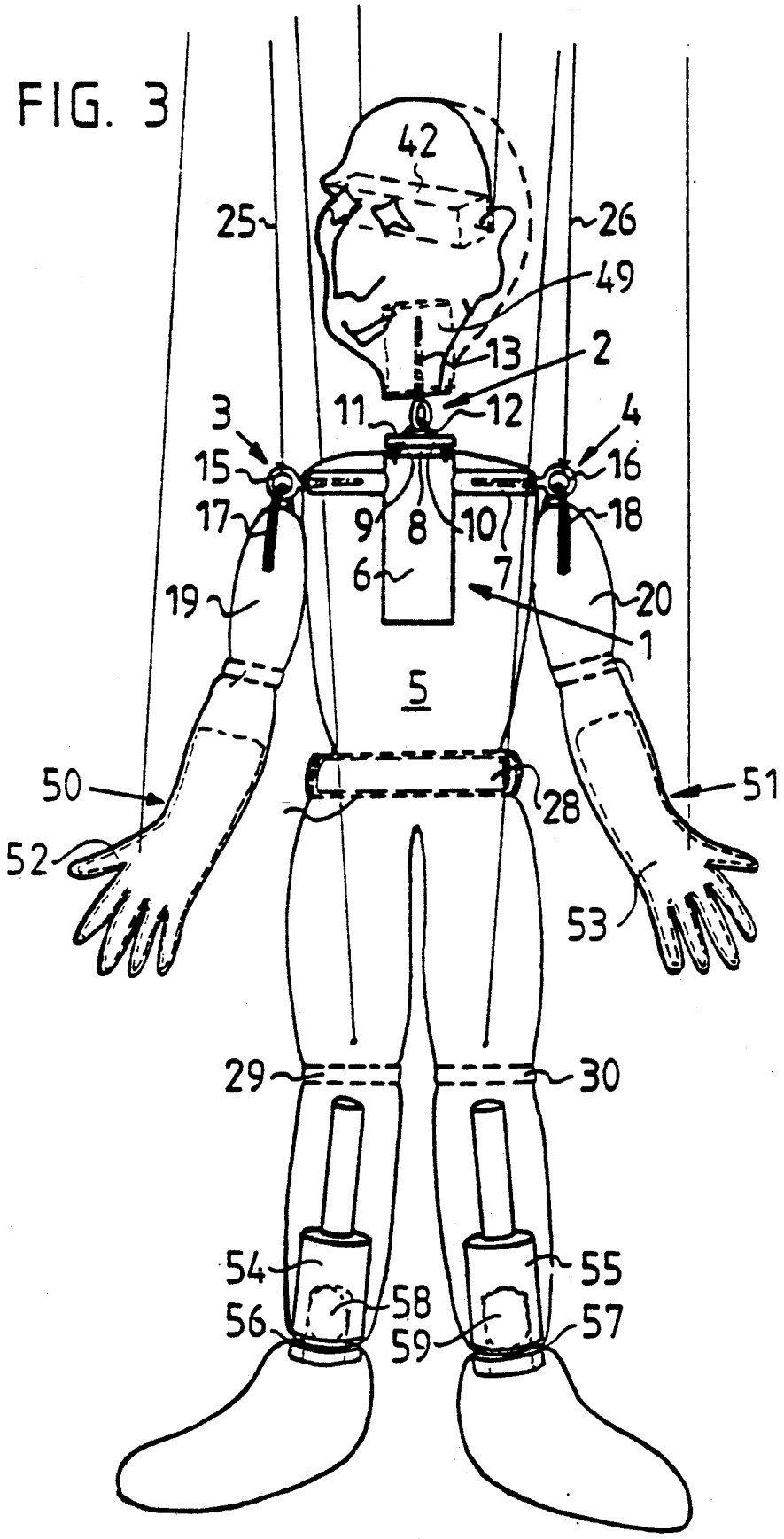
FIG. 3 shows a puppet made using the articulated assembly in accordance with the invention, with a stuffed mask head and stuffed extremities, in a frontal view.

FIG. 3 shows a stuffed doll that can be played with like a puppet. In the following, only those elements will be separately described which differ from the puppet in accordance with FIG. 1. On the one hand, there are the fore arms and hands 50, 51 which, in the toy doll shown here, are designed like those of stuffed doll.

A push-in hand 52, 53 made of flexible sheet metal can be inserted, respectively, into the covering tricot fabric for the forearm 50, 51 and into the hand, enabling various hand positions to be formed. To ensure that the stuffed doll is sufficiently maneuverable, a piece of lead can be sewn into the palms of the hands. Thus, the arms will hand down more loosely when the hand threads are released. For the feet, inserts similar to those in FIG. 1 are used. These are roundwoods 54, 55, having the same external shape, also with a round groove 56, 57 near their lower edge. The roundwoods 54, 55 exhibit, however, a drill hole instead of a slot on their underside into which a piece of lead 58, 59 can be inserted. In this way, the greatest weight is at the right place for playing, specifically, precisely at the foot articulation. The covering fabric of the lower leg can be drawn into the groove 56, 57. As with a stuffed doll, the feet are made from pieces of fabric stuffed and sewn together. These stuffed feet are sewed onto the lower legs while their upper fabric edge is drawn into the groove 56, 57.

I claim:

1. An articulated assembly for puppets and stuffed toy dolls, comprising:

a neck-shoulder element having a neck articulation and two shoulder articulations, said neck-shoulder element further including a first roundwood crossedly attached to a second roundwood, said second roundwood being thinner than said first roundwood;

a first eyebolt;

a first loop being secured to an upper front side of said first roundwood on which said first eyebolt is suspended as an eyelet;

a second loop and a third loop;

a second eyebolt and a third eyebolt each being attached to an end of said second roundwood, said second eyebolt and said third eyebolt forming eyelets through which said second loop and said third loop are capable of being drawn, so that each of said neck and shoulder articulations are formed by one of said eyelets in a closed mode with said first loop, said second loop and said third loop, respectively, being passed through one of said eyelets in said closed mode, each of said first loop, said second loop and said third loop being secured by a free end to one side of said neck and shoulder articulations, respectively;

two foot elements each having a foot articulation; and, means for attaching said two foot elements to said neck-and-shoulder element.

2. The articulated assembly for puppets and stuffed toy dolls according to claim 1, wherein said first roundwood is provided with a round groove on a side intended for attachment with said neck articulation.

3. The articulated assembly for puppets and stuffed toy dolls according to claim 1, wherein said upper front side of said first roundwood is provided with two holes disposed diagonally-downward and outward and, further including, a string drawn through said two holes for forming a closed loop over said first roundwood.

4. The articulated assembly for puppets and stuffed toy dolls according to claim 1, wherein said two foot articulations of said foot element are formed by a third roundwood and a fourth roundwood, respectively, each of said third roundwood and said fourth roundwood being provided, through their respective centers, with a traversing slot in which a foot eyebolt for each of said third roundwood and said fourth roundwood, are supported by an axis extending traversely said traversing slots of each of said third roundwood and said fourth roundwood.

5. The articulated assembly for puppets and stuffed toy dolls according to claim 1, wherein said two foot articulations of said foot element are formed by a fifth roundwood and a sixth roundwood, respectively, wherein each of said fifth roundwood and said sixth roundwood, on their respective bottoms, include a hole into which a lead weight is insertable.

6. The articulated assembly for puppets and stuffed toy dolls according to claim 4 or claim 5 wherein said third roundwood and said fourth roundwood or said fifth roundwood and said sixth roundwood are each provided with a round groove near a lower border so that each are capable of drawing in a fabric covering.

* * * * *